United States Patent [19]

Limbach et al.

[11] Patent Number: 4,905,979

[45] Date of Patent: Mar. 6, 1990

[54] DEVICE FOR STACKING SHEET MATERIAL

[75] Inventors: Gerhard Limbach, Wiesbaden; Wilfried Sonntag, Mainz, both of Fed. Rep. of Germany

[73] Assignee: Hoechst Aktiengesellschaft, Frankfurt am Main, Fed. Rep. of Germany

[21] Appl. No.: 241,868

[22] Filed: Sep. 8, 1988

[30] Foreign Application Priority Data

Sep. 10, 1987 [DE] Fed. Rep. of Germany ..... 3730403

[51] Int. Cl.[4] ..... B65H 29/46

[52] U.S. Cl. ..... 271/176; 271/189; 271/218; 414/791.2

[58] Field of Search ..... 271/189, 191, 207, 217, 271/218, 176; 414/791.2, 794.8, 907

[56] References Cited

U.S. PATENT DOCUMENTS 3,860,127 1/1975 Fassman ..... 414/791.2
4,208,122 6/1980 Iwamoto ..... 414/791.2 X
4,477,218 10/1984 Bean ..... 414/791.2 X

FOREIGN PATENT DOCUMENTS 2622781 12/1977 Fed. Rep. of Germany .
2902261 7/1980 Fed. Rep. of Germany .

*Primary Examiner*—Richard A. Schacher
*Attorney, Agent, or Firm*—Foley & Lardner, Schwartz, Jeffery, Schwaab, Mack, Blumenthal & Evans

[57] ABSTRACT

A device for stacking sheet material in the form of individual stacks comprises a fixed stop, a vertically movable stop, a support surface, a sensor and a guide member, to which two pushers are fastened, which are activated by lifting cylinders. The sheet material to be stacked is conveyed by conveying rollers and falls down freely between one of the stops and a stop face where the individual stacks are formed. The guide member can be raised and lowered about a pivot by means of a lifting cylinder which engages a pivot point provided at the underside of the guide member. Stacking is performed in individual stacks, whereby two super-imposed individual stacks each are mutually offset in the direction of transport Z by a distance of displacement x.

14 Claims, 1 Drawing Sheet

DEVICE FOR STACKING SHEET MATERIAL

BACKGROUND OF THE INVENTION

The present invention relates to a device for stacking sheet material so as to form individual stacks which are each comprised of a preselected number of sheets, whereby the number of sheets successively delivered and conveyed onto an individual stack by means of conveying rollers is kept constant for each stack and the individual stacks are piled up to form a full stack.

For stacking sheet material cut to a specific size, such as, for example, metal plates or sheets of paper or other materials, it is known, prior to depositing a stack of sheet material, to insert two cardboard sheets of the same size as an intermediate layer and then to stack these intermediate sheets together with the cut-to-size sheets of material. The cardboard sheets mark the individual stacks and divide the full stack into individual stacks, thus facilitating the production of individual packs comprising a certain number of sheets from the full stack.

In particular, for dividing stacks of paper into individual stacks comprising 1,000 sheets, which are commonly referred to as reams, it is usual to mark the individual stacks by inserting strips of material between them, whereby the portions of the strips which protrude from the stacks are bent downwardly and closely adjoin the stack surface. It is a disadvantage that the loosely inserted strips often slip out of the stack, so that the ream marking is lost and, moreover, the slipped-out strips may impede the sheet stacking process.

German Offenlegungsschrift 29 02 261 discloses a process for marking reams comprising a predetermined number of sheets, where the sheets which are sequentially delivered onto the stack are counted and the ream is marked when the preselected number of sheets is reached. For this purpose, the counter pulses are stored and when the stacking of the preselected number of sheets is completed, a stamping device is activated, by which the head end of the upper portion of the ream is ink-marked, the stamp print gradually fainting in the downward direction and the lowest portion of the respective ream remaining free from ink. The device for performing this process comprises a stamp which is arranged at the head end of the sheet stacking device and is angularly fastened to a rod which can be moved to and fro.

German Offenlegungsschrift 26 22 781 describes a device for removing a ream consisting of a preselected number of sheets from a pile of sheet-like material. This device comprises a vertically and horizontally displaceable, table-like platen which can be introduced into the pile in the horizontal direction and which, at its front edge which is to be inserted into the pile, is provided with a rotating roller by which the pile is spread. During the insertion of the table-like platen into the stack the advance speed of the platen and the circumferential speed of the roller are substantially identical. Over a portion of its length, the table-like platen is conically reinforced, the reinforced portion starting at the front edge and extending away from the roller. At the end of the conically reinforced portion a second roller is provided in the surface of the table-like platen, in parallel alignment with the first roller and at a distance therefrom. The circumferential speed of the second roller essentially corresponds to the circumferential speed of the first roller and the advance speed of the table-like platen.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

It is an object of the present invention to develop a device which makes it possible to subdivide a full stack of sheet material into a number of separate individual stacks which each comprise a predetermined number of sheets, without having to employ any kind of markings.

A further object of the invention resides in the provision of a method for stacking separate stacks of sheets.

In accomplishing the foregoing objects, there has been provided in accordance with one aspect of the invention a device for stacking sheet material so as to form individual stacks each having a preselected number of sheets, where the number of sheets successively delivered and conveyed onto the respective individual stack by means of conveying rollers is kept constant for each stack and the individual stacks are piled up to form a full stack, comprising a base having an upper support surface, a fixed stop and a vertically movable stop adjacent thereto at a head end of the base and a stop face at a rear end of the base, the fixed stop and the stop face being separated by a distance y corresponding to the length of the sheet material to be stacked plus a distance x corresponding to the distance by which two superimposed individual stacks are mutually staggered in the direction of transport Z, and pusher means which can be displaced vertically for selectively holding and horizontally shifting an individual stack until the stack rests against the fixed stop.

In accordance with another aspect of the invention, there has been provided a method of stacking sheet material so as to form individual stacks with a stacking device, comprising the steps of forming a first stack to a predetermined stack height, forming a second stack to said predetermined stack height so that a first end of the second stack is maintained in a raised position relative to the first stack, and moving the second stack by pushing the raised end thereof in a horizontal direction relative to the first stack for offsetting the second stack from the first stack by a predetermined distance.

Further objects, features and advantages of the invention become apparent from the following detailed description of preferred embodiments when considered in conjunction with the accompanying drawing figures. It is to be expressly understood however, that the drawing figures are not intended to be a definition of the invention but are for the purpose of illustration only.

BRIEF DESCRIPTION OF THE DRAWINGS

The invention will now be explained in greater detail with reference to the attached drawing figures, of which.

DETAILED DESCRIPTION OF THE PREFERRED EMBODIMENTS

In accordance with the instant invention, a device is provided where a fixed stop and a vertically movable stop are arranged at the head end of the device and a stop face is arranged at the rear end of the device, where the distance between the fixed stop and the stop face is equal to a distance "y" corresponding to the length of the sheet material to be stacked, plus a distance "x" corresponding to the distance by which two individual stacks are mutually offset in the direction of transport "Z", and where pushers which can be displaced vertically are provided for holding and shifting the individual stacks in the horizontal direction until they rest against the fixed stop. Conveying rollers mounted above and, seen in the direction of transport "Z", ahead of the stop face feed the sheet material to be stacked into the device, such that the sheet material in the form of plates is conveyed against the stop by the conveying rollers and the sheet material passing between the conveying rollers freely falls down between the stop and the stop face onto a support surface where the individual stacks are formed.

Figure 1:
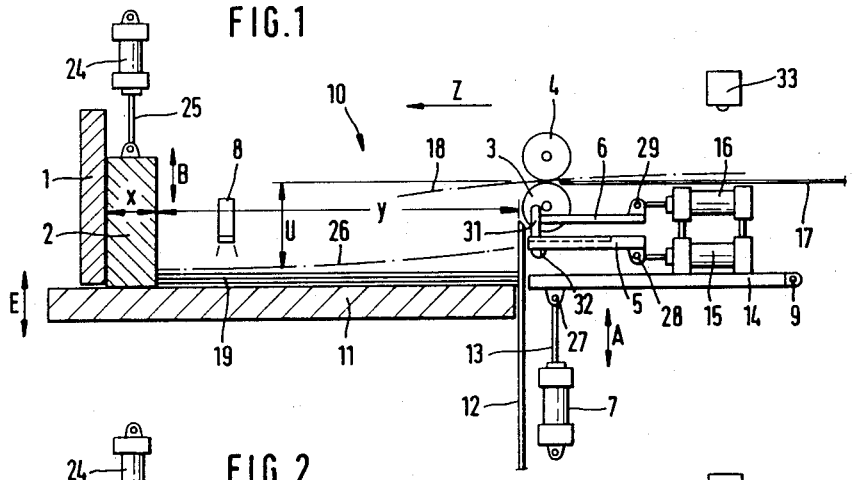
FIG. 1 shows a diagrammatic sectional view of the device according to this invention during the deposition of the first individual stack.

The device 10, shown in a diagrammatic sectional view in FIG. 1, comprises a fixed stop 1, a vertically movable stop 2 adjoining the fixed stop 1, a stop face 12, a support surface 11, which can be raised and lowered in the direction of the double arrow E, sensors 8 and 33, a guide member 14, to which two pushers 5 and 6 are fastened in parallel alignment in respect of each other, and conveying rollers 3 and 4, by which sheet material 18 in the form of plates, sheets or films is transported onto the support surface 11. The support surface 11 may, for example, be a pallet, but it may also be a vertically adjustable conveying belt which during the stacking process stands still and then transports away the completed full stack. The sheet material 18, which is conveyed along a transport path 17 by the conveying rollers 3, 4 and in general is cut to a specific size, is conveyed against the stop 2 lowered onto the support surface 11 and falls down freely between the stop 2 and the stop face 12. The height of fall U, i.e., the distance between the level of the transport path and the uppermost sheet of the stack being formed, is kept constant. The fixed stop 1 and the movable stop 2 are positioned at the head end of the device 10, whereas the stop face 12 is located at the rear end of the device 10. The distance between the fixed stop 1 and the stop face 12 is equal to the distance corresponding to the length y of the sheet material 18, 26 to be stacked, plus a distance x of mutual staggering between two super-imposed individual stacks, which will be explained in detail below, seen in the direction of transport Z. The conveying rollers 3, 4 are located above and, seen in the direction of transport Z, ahead of, the stop face 12.

The support surface 11 extends from the stop face 12 beyond the fixed stop 1 and is provided below the latter.

At a distance greater than the preselected height of the full stack, and perpendicular in respect of the support face 11, there is arranged a sensor 8, for example, a non-contacting sensor, which controls the predetermined height of the individual stacks and of the full stack with the aid of light, ultrasound or, in the case of metallic materials, induction measurement. The height of fall U of the individual cut-to-size sheets is kept constant by the sensor 8, which controls the lowering of the support surface 11 in the direction of the double arrow E, as a function of the increasing height of the stack. Lowering in the direction of the double arrow E is generally effected by a hydraulic, pneumatic or electromechanical system (not shown in the drawing), which is triggered by the sensor 8. When an individual stack comprises a certain, preset number of sheets 18, the operation control system receives a triggering signal from a counting sensor 33 located above the path of transport 17 of the sheet material 18, so that the stop 2 is raised by a lifting cylinder 24, via a piston rod 25, in the direction of double arrow B, whereby the lifting distance is somewhat greater than the height of stacking predetermined by the sensor 8.

A guide member 14 is located in front of the stop face 12, seen in the direction of transport Z. A pivotal point 27 is provided on the underside of the guide member 14, a piston rod 13 of a vertically arranged lifting cylinder 7 being fastened to this pivotal point 27 and it being possible for the lifting cylinder 7 to raise and lower the guide member 14 in the direction of double arrow A, about a pivot 9 located at the other end of the guide member 14, i.e., the end which does not adjoin the stop face 12. Two lifting cylinders 15 and 16 are fastened to the guide member 14, the piston rods of these cylinders being connected to the pushers 5 and 6 via pivotal points 28 and 29. The two pushers 5 and 6 are in parallel alignment in respect of each other. A protrusion 32 is provided at the underside of the lower pusher 5 and a stop plate 31 is fastened to the leading end of the upper pusher 6. The stop plate 31 and the protrusion 32 are, for example, made from a tough elastic material to avoid damaging of the sheet material to be stacked. The pushers can be moved to and fro in the direction of double arrows C and D (FIG. 3), parallel to the guide member 14. The guide member 14 can in turn be raised and lowered in the direction of double arrow A by means of the lifting cylinder 7, about the pivot 9. The pushers 5 and 6, which via the guide member 14 can also be displaced in the vertical direction, serve to hold and horizontally shift the individual stacks until these rest against the fixed stop 1. This will be described in detail below.

Figure 2:
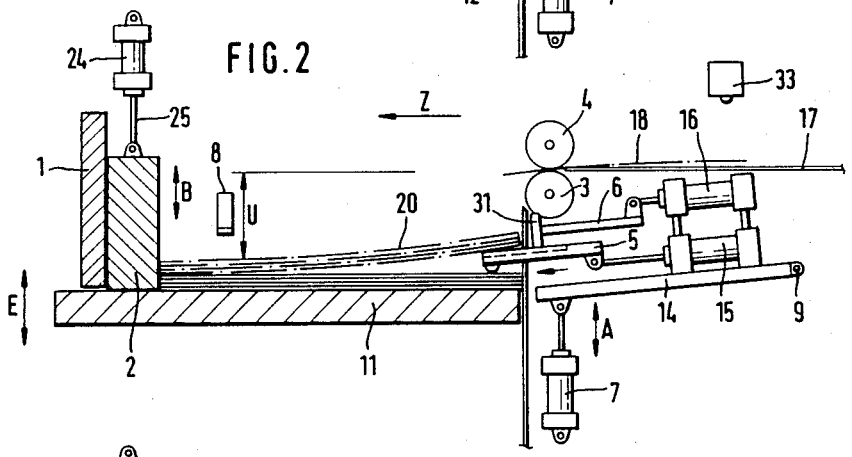
FIG. 2 shows the device according to this invention, where the leading edges of the second individual stack rest on the first individual stack while the trailing edges of the sheets constituting the second individual stack are being piled up onto an extended pusher.

FIG. 1 shows the formation of the first individual stack 19 which rests against the stop 2 and has reached its predetermined final stack height. Now the lower pusher 5 is extended, and simultaneously the guide member 14 is lowered by the lifting cylinder 7 in the direction of double arrow A, until the protrusion 32 of the extended pusher 5 comes to rest on the first individual stack 19. This situation is diagrammatically shown in FIG. 2. The protrusion 32, which rests on the uppermost sheet of the first individual stack 19, holds the stack 19 and secures it against any undesired displacement. In this position, the individual sheets of sheet material 26 are stacked between the stop 2 and the stop face 12 or, respectively, the still extended pusher 5, to form the second individual stack 20, the sheets being delivered by the conveying rollers 3 and 4 and falling down freely. One end of this second stack 20 rests against the stop 2, whereas its other end rests on the inclined lower pusher 5. When the second stack comprises the preselected number of individual sheets, which is controlled by the sensor 33, the stop 2 is lifted and the upper pusher 6 is extended, so that its stop plate 31 presses against the rear ends of the sheets forming the second individual stack and displaces the stack by a distance x until the leading edges of the sheet material rest against the fixed stop 1. Thereby, the rear edges of the second individual stack 20 are pushed down from the lower pusher 5, so that at the end of this step the second individual stack 20 rests on the first individual stack 19 and protrudes from the latter, in the direction of transport Z, by the distance of displacement x. The distance of displacement x corresponds to the thickness (horizontal) of the movable stop 2.

Immediately after the second individual stack 20 has been pushed through, the movable stop 2 is lowered onto the second individual stack 20, so that the sheets of the next, third individual stack 21 are stacked between the movable stop 2 and the stop face 12, in the same way as described in detail with regard to the first individual stack 19. Due to the fact that the stop 2 rests firmly on the second individual stack 20 any undesired displacement of the uppermost sheet of the first individual stack 19, which might be caused by the movement of the pusher 5 back to its original position, is avoided. The guide member 14 and the pushers 5 and 6 return to their original positions shown in FIG. 1, so that the third individual stack 21 is formed in the same way as the first individual stack 19.

The fourth individual stack 22 is piled up in the same way as the second individual stack 20. Principally, all individual stacks having odd numbers are formed as described in connection with the first individual stack 19, and all individual stacks having straight numbers are formed as described in connection with the second individual stack 20.

Figure 3:
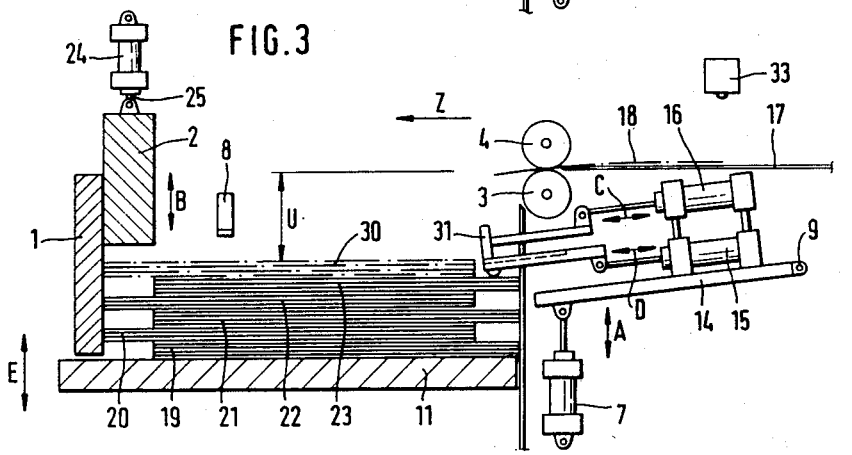
FIG. 3 shows the device according to this invention during the deposition of the last individual stack of a full stack.

FIG. 3 diagrammatically illustrates the formation of a sixth individual stack 30, which has just been pushed down from the lower pusher 5 by the upper pusher 6.

Instead of the hydraulic or pneumatic lifting cylinders 7, 15, 16, 24, step motors and/or lifting magnets may also be used to drive the guide member 14, the pushers 5 and 6 and the stop 2.

This invention presents the advantage that the individual stacks can be piled up to form an exactly aligned full stack without any undesired offsetting of single sheets whereby due to the mutual staggering of two super-imposed individual stacks in the direction transport "Z" the individual stacks can be distinguished from one another without having to apply any markings. The absence of any marking means prior to the deposition of the individual stacks and the mutually staggered arrangement of the individual stacks in the full stack facilitate the subsequent manual or automatic packing of the individual stacks.

What Is Claimed Is:

1. A device for stacking sheet material so as to form individual stacks each having a preselected number of sheets, where the number of sheets successively delivered and conveyed onto the respective individual stack by means of conveying rollers is kept constant for each stack and the individual stacks are piled up to form a full stack, comprising:

a base having an upper support surface;

a fixed stop and a vertically movable stop adjacent thereto at a head end of the base and a stop face at a rear end of the base;

the fixed stop and the stop face being separated by a distance y corresponding to the length of the sheet material to be stacked plus a distance x corresponding to the distance by which two super-imposed individual stacks are mutually staggered in the direction of transport Z; and pusher means which can be displaced vertically for selectively holding and horizontally shifting an individual stack until the stack rests against the fixed stop.

2. A device as claimed in claim 1, further comprising:

conveying rollers mounted above and, ahead in the direction of the transport Z of the stop face for conveying the sheet material against the movable stop, so that the sheet material passing between the conveying rollers freely falls down onto the support surface, between the movable stop and the stop face, and is piled up in the form of individual stacks.

3. A device as claimed in claim 2, wherein the support surface extends from the stop face beyond the fixed stop and below the fixed stop.

4. A device as claimed in claim 1, wherein the pusher means are connected to lifting cylinders via pivot points, the lifting cylinders being fastened to a guide member which can be pivoted about a pivot provided at the end of the guide member, which is opposite the stop face.

5. A device as claimed in claim 4, further comprising:

a vertically retractable and extendable lifting cylinder connected to the guide member via a pivot point provided at the underside of the guide member close to the stop face, by which the guide member is raised and lowered.

6. A device as claimed in claim 2, further comprising:

means, including a first non-contacting sensor provided above the support surface at a distance greater than the predetermined height of the full stack, for measuring the height of the individual stacks keeping constant the height of fall (U) by lowering of the support surface by a distance corresponding to the increase in stack height.

7. A device as claimed in claim 2, further comprising:

means, including a second non-contacting sensor provided ahead of the conveying rollers and above the path of transport, for counting the number of individual sheets of the sheet material to be stacked and raising the movable stop when the individual stack has reached a predetermined number of counted sheets.

8. A device as claimed in claim 5, wherein the movable stop rests on the support surface, and the pusher means comprises first and second pusher means, said first pusher means including means protruding from the underside thereof for resting on a first individual stack for holding the first stack in place when the guide member is in a lowered, inclined position.

9. A device as claimed in claim 8, wherein the first individual stack includes a first end resting on the first pusher means and a second end resting against the movable stop, means for vertically raising the movable stop and means for extending the second pusher for moving the second stack against the fixed stop while the movable stop is raised, in response to the second stack reaching a predetermined height, and the means for vertically raising the movable stop also including means for lowering the movable stop onto the moved second stack.

10. A device as claimed in claim 9, further comprising means for moving the first and second pushers and the guide member to an original starting position prior to forming the first individual stack and prior to forming third and fourth stacks similar to the first and second stacks.

11. A device as claimed in claim 10, wherein the means for moving the first and second pushers, the movable stop and the guide member includes fluid powered lifting cylinders.

12. A method of stacking sheet material so as to form individual stacks with a stacking device having a movable stop, a guide member and a first pusher having a protrusion on an underside thereof, comprising the steps of:

forming a first stack to a predetermined stack height, and resting the movable stop on a support surface upon which said first stack is formed during said forming of said first stack;

when the first stack has reached said predetermined height, lowering the guide member to an inclined position;

extending the first pusher so that the protrusion on an underside thereof rests upon the first stack and holds the first stack in place;

forming a second stack to said predetermined stack height so that a first end of the second stack is maintained in a raised position relative to the first stack; and moving the second stack by pushing the raised end thereof in a horizontal direction relative to the first stack for offsetting the second stack from the first stack by a predetermined distance.

13. The method of claim 12, further comprising the steps of:

resting said first end of the second stack on the first pusher;

resting a second end of the second stack against the movable stop;

when the second stack has reached the predetermined height, raise the movable stop;

extending a second pusher for offsetting the second stack until the second end of the second stack is pressed against a fixed stop; and lowering the movable stop onto the second end of the second stack.

14. The method of claim 13, further comprising the steps of:

moving the first and second pushers and the guide member to an original starting position; and forming third and fourth stacks in the manner in which the first and second stacks, respectively, were formed.

* * * * *